United States Patent [19]

Wu et al.

[11] Patent Number: 4,990,731

[45] Date of Patent: Feb. 5, 1991

[54] PUSHBUTTON SWITCH WITH TACTILE AND AUDITORY CONFIRMATION OF OPERATION

[75] Inventors: Win Wu; Ben Liao; Lung-Sherng Hsieh, all of Taipei, Taiwan

[73] Assignee: Acer Incorporated, Taiwan, China

[21] Appl. No.: 386,099

[22] Filed: Jul. 28, 1989

[51] Int. Cl.[5] ..... H01H 13/14; H01H 3/12

[52] U.S. Cl. ..... 200/521; 200/559; 200/345

[58] Field of Search ..... 200/520, 521, 512, 517, 200/559, 308, 329, 341, 345, 342, 510; 400/490, 491.2, 491.3

[56] References Cited

U.S. PATENT DOCUMENTS

| | | | |
|---|---|---|---|
| 3,464,532 | 9/1969 | Tibbetts | 400/491.3 |
| 3,866,006 | 2/1975 | Westram | 200/521 |
| 4,479,040 | 10/1984 | Denley et al. | 200/517 |
| 4,553,009 | 11/1985 | Van Zeeland et al. | 400/491.3 |
| 4,642,433 | 2/1987 | Murata | 200/517 |

FOREIGN PATENT DOCUMENTS

| | | | |
|---|---|---|---|
| 262421 | 6/1968 | Austria | 200/345 |

*Primary Examiner*—Ernest G. Cusick
*Assistant Examiner*—Keith Kupferschmid
*Attorney, Agent, or Firm*—Townsend and Townsend

[57] ABSTRACT

A pushbutton switch for use in a keyboard attached to a computer system, word processor, electric typewriter, etc., is implemented to give the operator both a tactile feel and a click sound when a key is entirely depressed. The switch comprises a housing, an actuating arm, a stem and a leaf spring mechanism. The leaf spring has an upright portion with a hook, a bent portion, a spring portion and a protruding portion. It is mounted in the housing such that when the stem is partially depressed, it forces the upright portion to slant toward the inner surface of side wall of the housing and the spring portion to be compressed. When the spring is depressed beyond a certain position, the protruding portion of the leaf spring slips off the ledge of the step portion of the side wall of the housing, causing the bent portion to snap toward and collide with the outer surface of the stem, thus producing the desired click sound.

2 Claims, 2 Drawing Sheets

PUSHBUTTON SWITCH WITH TACTILE AND AUDITORY CONFIRMATION OF OPERATION

BACKGROUND OF THE INVENTION

1. Field of the Invention

The invention relates to a pushbutton switch for use in a keyboard attached to a computer system, word processor, electric typewriter, etc., and more particularly to a pushbutton switch which, when entirely depressed, allows the human operator to sense the completion of the operation through the production of a click sound and a tactile sensation.

2. Description of the Prior Art

The pushbutton switch is designed to provide the operator with a tactile feedback mechanism so that, when a switch is entirely depressed, the operator can sense the actuation of the switch. When she recognizes this, she can release the switch. As a result, the keyboard is more convenient to use and minimizes fatigue. Pushbutton switches of this kind are disclosed in U.S. Pat. Nos. 4,447,681, 4,553,009 and 4,642,433, where other variations of this switch are detailed.

SUMMARY OF THE INVENTION

The principal function of the invention is to provide a pushbutton switch that, in order to facilitate the work of the operator, includes a feedback mechanism and produces both a tactile feel and a clicking sound within the switch housing when the key is entirely depressed.

The above function is achieved by a pushbutton switch comprising: a housing; a pushbutton stem; a leaf spring having an upright portion with a hook end accommodated with the end of the stem. The leaf spring has a bent portion which extends from the upright portion toward the bottom end of the stem; a spring portion extending upward at an angle from said bent portion and provided with a protruding portion on the end of the spring portion, the protruding portion being pressed against the ledge of the step portion of the side wall of the housing.

DETAILED DESCRIPTION OF THE PREFERRED EMBODIMENTS

Figure 1:
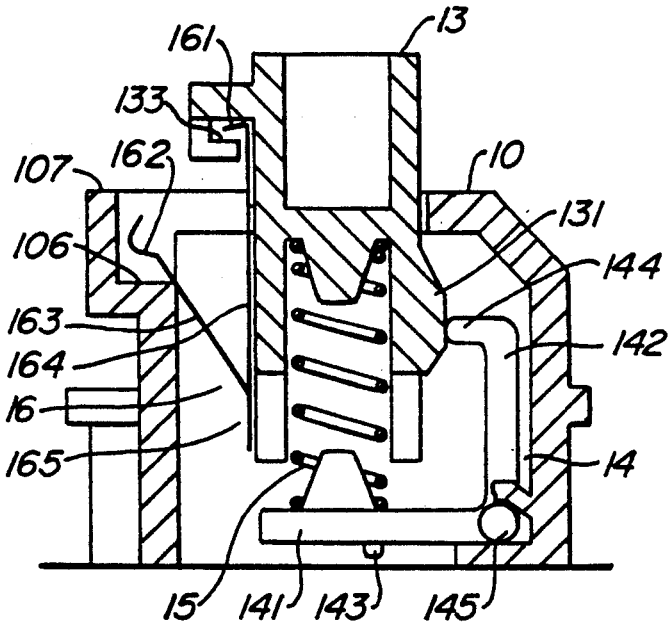
FIG. 1 is a side elevation in a cross-section of an entire pushbutton switch in which the switch is not depressed.

Referring to FIGS. 1–4, there is shown a pushbutton switch embodying the present invention. This switch includes a housing 10, a stem 13, a leaf spring 16, an L-shaped actuating arm 14, and a biasing means 15.

FIG. 1 depicts the present invention in its non-depressed position. It shows the OFF positions of: the stem 13, the surface cam 131 of the stem 13, the actuating arm 14, the leaf spring 16, and the protruding portion 162 of the leaf spring 16.

FIG. 1 also depicts the following non-moving parts: the housing 10 with opening on the top surface 107 of the housing.

The invention includes a pushbutton switch comprising: a housing 10; a pushbutton stem 13; a leaf spring 16 having an upright portion 164 with a hook end the stem 13. The leaf spring 16 has a bent portion 165 which extends from the upright portion 164 toward the bottom end of the stem from said bent portion 165 and provided with a protruding portion 162 on the end of the spring portion 163.

The housing 10 generally has side walls and a bottom. The inner surface of side wall of the housing corresponding to slot 133 of stem 13 has a step configuration 106 as shown in FIG. 1. When stem 13 is undepressed, spring portion 163 of leaf spring 16 is rested on the ledge of step portion 106 of the side wall.

Stem 13 is mounted for reciprocal movement within housing 10 and projecting outwardly from housing 10 through said opening on top surface 107. Actuating arm 14 has a shaft 145 pivoted to housing 10, and has a first portion 141 extending beneath stem 13. Actuating arm 14 has a second portion 142 having a single cam surface 144 which engages the single cam surface 131 of stem 13 during both directions of the reciprocal movement of said stem. Biasing means 15 is disposed between stem 13 and first portion 141 of the actuating arm 14 to urge stem 13 outwardly from the housing.

Leaf spring 16 is disposed between the outer surface of stem 13 and the corresponding inner surface of the side wall of housing 10 which has the step configuration step 106. Hook end 161 is accommodated within slot 133 of stem 13.

During the process of the downward movement of the stem 13, the protruding portion 162 of the leaf spring 16 rubs against the ledge of the step portion 106 and slips off, causing the desired tactile feel. Then, the bent portion 165 is forced to strike the outer surface of stem 13, causing the desired click sound.

Figure 2:
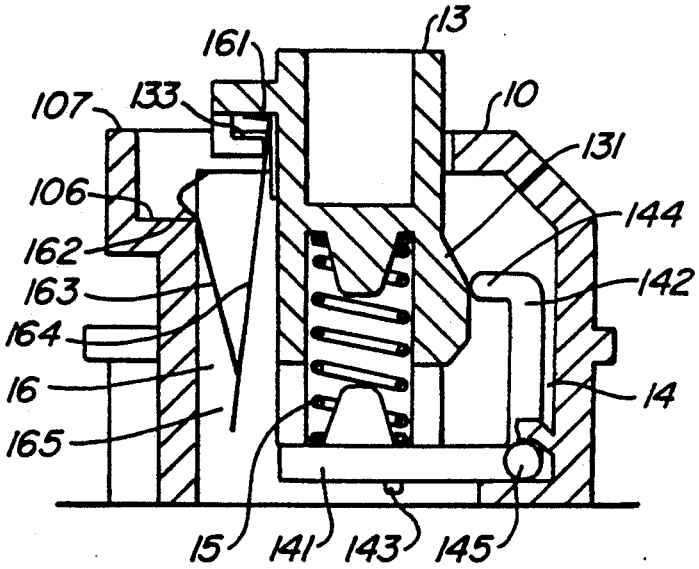
FIG. 2 is a side elevation in a cross-section of an entire pushbutton switch in which the switch is partially depressed.
Figure 3:
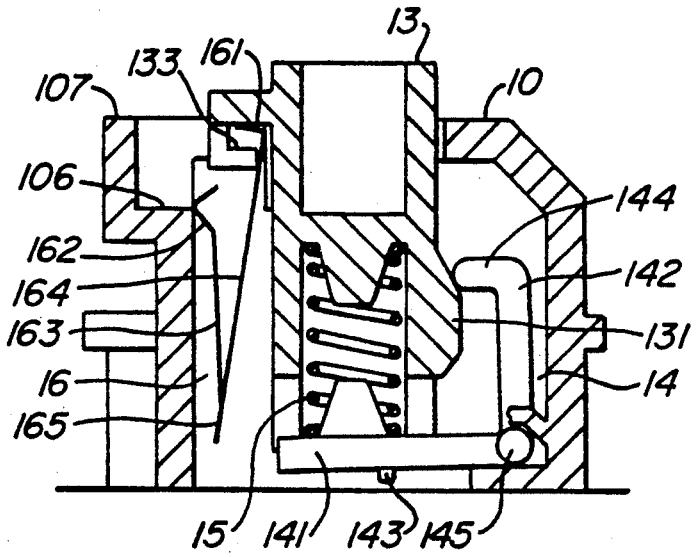
FIG. 3 is a side elevation in a cross-section of an entire pushbutton switch at the moment at which the tactile sensation is felt by the operator.
Figure 4:
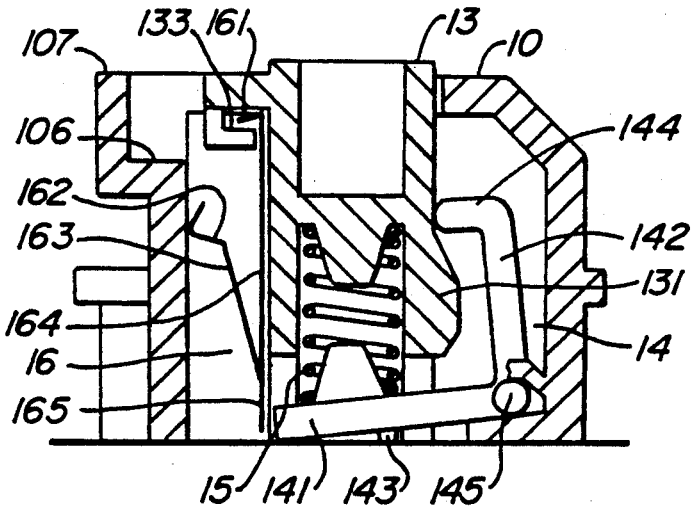
FIG. 4 is a side elevation in cross-section of an entire pushbutton switch at the moment at which the click sound occurs.

FIGS. 2–4 depict the action of the invention. In FIG. 2 stem 13 is pressed inwardly to a point such that the protruding portion 162 of the leaf spring begins to rub against the ledge of step portion 106, but has not yet slipped off. Therefore, upright portion 164 is forced to slant away from the left outer surface of stem 13. Before the closing position of the switch is reached, the position of the two cooperating cam surfaces 131 and 144 prevents movement of actuating arm 14 to a switch closing position.

FIG. 3 depicts the action of the present invention precisely when the stem has been depressed such that the protruding portion 162 slips off the ledge of the step portion 106 and the tactile sensation is felt by the operator.

FIG. 4 depicts the action of the present invention when stem 13 has been entirely depressed. The stem 13 has moved inwardly a given distance such that the position of cam 144 has passed a given point on cam 131 of stem 13. Then the actuating arm 14 can rotate to actuate the switch by pressing the element 143 to hit against the bottom of switch housing 10. Simultaneously, the protruding portion 162 of the leaf spring 16 has already slipped off the ledge of the step portion 106. At this point, the upright portion 164 can return to its upright position, and the bent portion 165 strikes the left outer surface of the stem 13, producing the desired click sound for the operator. And at the same time the element 143 is hit against the bottom of switch housing 10 to its closing position.

Whereas the preferred form of the invention has been shown and described herein, it should be realized that there may be many modifications, substitutions and alterations thereto.

The embodiments of the invention in which an exclusive property or privilege is claimed are defined as follows:

We claim:

1. A pushbutton switch with tactile and auditory confirmation of operation comprising:

(a) a housing adapted to be positioned on a switch, said housing having an opening on its top surface;

(b) a stem mounted for reciprocal movement within the housing and projecting outwardly from the housing through said opening on the top surface of said housing;

(c) an L-shaped actuating arm having a shaft pivotally mounted in said housing, and positioned for engagement by said stem;

(d) a spring means disposed between the stem and the actuating arm to urge the stem outwardly from the housing;

(e) cooperating cam surfaces on said stem and actuating arm preventing movement of said arm to a switch closing position until said stem has moved inwardly a given distance;

(f) a leaf spring disposed between an outer surface of the stem and an inner surface of a side wall of the housing, said spring being coupled to said stem;

(g) wherein the leaf spring moves substantially as the stem is depressed inwardly beyond a certain point, causing a tactile feel and a click sound for the operator.

2. A pushbutton switch with tactile and auditory confirmation of operation comprising:

(a) a housing adapted to be positioned on a switch, said housing having a step portion on an inner surface of one side wall and an opening on a top surface of the housing;

(b) a stem mounted for reciprocal movement within the housing and projecting outwardly from the housing through said opening on the top surface of said housing, said stem having a slot;

(c) an L-shaped actuating arm having a shaft pivotally mounted in said housing and positioned for engagement by said stem;

(d) a spring means disposed between the stem and the actuating arm to urge the stem outwardly from the housing;

(e) cooperating cam surfaces on said stem and actuating arm preventing movement of said arm to a switch closing position until said stem has moved inwardly a given distance;

(f) a leaf spring disposed between an outer surface of the stem and an inner surface of a side wall of the housing, said spring having an upright portion with a hook end accommodated within said slot of said stem, a bent portion extends inward from the upright portion, a spring portion extending upward at an angle from said bent portion, said spring situated on the ledge of said step portion of the housing, and a protruding portion on the end of the spring portion,;

(g) wherein as the stem is depressed inwardly beyond a certain position, the protruding portion of the leaf spring slips off the ledge of the step portion, causing a tactile feel for the operator, at essentially the same time, the bent portion snaps toward and collides with the outer surface of the stem, producing a clicking sound for the operator.

* * * * *